US005194020A

United States Patent [19]

Voltz

[11] Patent Number: 5,194,020

[45] Date of Patent: Mar. 16, 1993

[54] HIGH-DENSITY COAXIAL INTERCONNECT SYSTEM

[75] Inventor: John A. Voltz, Hockessin, Del.

[73] Assignee: W. L. Gore & Associates, Inc., Newark, Del.

[21] Appl. No.: 782,950

[22] Filed: Oct. 25, 1991

Related U.S. Application Data

[63] Continuation-in-part of Ser. No. 716,079, Jun. 17, 1991.

[51] Int. Cl.[5] ..... H01R 17/04

[52] U.S. Cl. ..... 439/579; 439/540; 439/581

[58] Field of Search ..... 439/578-585, 439/675, 92, 540, 607, 610

[56] References Cited

U.S. PATENT DOCUMENTS

| | | | |
|---|---|---|---|
| 4,484,792 | 11/1984 | Tengler et al. | 439/578 |
| 4,889,500 | 12/1989 | Lazar et al. | 439/579 |
| 4,897,046 | 1/1990 | Tengler et al. | 439/579 |
| 4,941,831 | 7/1990 | Tengler et al. | 439/579 |

*Primary Examiner*—David L. Pirlot
*Attorney, Agent, or Firm*—Gary A. Samuels

[57] ABSTRACT

A high-density coaxial interconnect system for connecting an array of closely packed coaxial cable connectors to an electrical signal transmission system while maintaining a ground-shielded signal path through the interconnect system components from coaxial cable to the board.

11 Claims, 10 Drawing Sheets

HIGH-DENSITY COAXIAL INTERCONNECT SYSTEM

CROSS REFERENCE TO RELATED APPLICATION

This application is a continuation-in-part of application U.S. Ser. No. 07/716,079, filed Jun. 17, 1991.

FIELD OF THE INVENTION

The present invention relates to high-density coaxial interconnect systems and assemblies for termination of coaxial electrical signal cables to electrical signal transmission systems, such as printed circuit boards (PCB's), which can be easily assembled and attached to or detached from the signal transmission system.

BACKGROUND OF THE INVENTION

High speed computers, the use of large scale integrated circuits, highly varied and non-standard assembly processes, and sophisticated design parameters are demanding increasing precision, quality, and order of magnitude reliability and improved electrical properties of electrical connectors utilized to link the components comprising advanced systems.

The connector system must match or improve upon the characteristics of PCB's and transmission lines with respect to impedance control, attenuation, noise, cross talk, loss of signal, and circuit use time at increasing signal and ground contact densities.

Increased reliability and matching of the electrical characteristics of components must be taken into consideration within each component and at the interfaces between components of a circuit system.

Consistent reliability and reproducibility must be designed into connector components which are used at increasingly high signal and ground densities and accommodated within an ever decreasing unit of space, while at the same time maintaining matched impedances from transmission line through the system to a PCB.

The present invention provides a solution to many of the above connective requirements in a high-density coaxial interconnect system for linking coaxial signal transmission lines to PCB's having the requisite properties and reliability.

SUMMARY OF THE INVENTION

The invention comprises a high-density coaxial interconnect system or assembly, including the following linked components:

One component is coaxial signal cables terminated to a coaxial connector system, which includes an insulator surrounding the end of the terminated cable and signal contact and a conductive ground shell surrounding the insulator and signal contact. Coaxial connectors are described in detail in U.S. Pat. No. 4,867,707.

Another component is a linear grouper configured in the form of an elongated molded plastic housing holds in fixed linear juxtaposed array a multiplicity of the above coaxial connectors. Means such as beads, grooves and the like, molded into an inner surface of the linear grouper, matingly engage and hold in place the individual connectors in the linear grouper. Means to engage other cooperating means to hold the linear grouper in place in the system may be molded on outside surfaces of the linear grouper, such as means to matingly engage corresponding cooperating means molded into an inside or outside surface of a connector grouper frame, such as snap locks, for example. An adhesive may also be used to hold the coaxial connectors in place in the linear grouper in place of the molded means.

A connector grouper frame comprises a molded, cast, or machined frame configured to hold in place an array of juxtaposed linear groupers, including means molded into the grouper frame to engage cooperating molded means molded into the linear groupers for that purpose. The coaxial connectors held by the groupers and the groupers fitted into the grouper frame extend from the lower surface of the grouper frame in order that they may be inserted into header chutes. The linear groupers and grouper frame may have snap lock or other means molded, cast, or machined into them to hold them together when assembled.

Header chutes comprise elongated molded plastic block components which include cylindrical slotted parallel bores configured to receive the protruding ends of the conductive ground shells of the coaxial connectors housed as a unit within the connector groupers. A number of header chutes are housed Juxtaposed within a header frame, which may include means molded into a surface to hold the header chutes in place within it and cooperate with holding means molded, cast or machined into the outer surfaces of the header chutes for that purpose.

The header chutes have electrical signal contact pins affixed in the bottom surface of each cylindrical bore or aperture which houses the conductive ground shell of a coaxial connector which extends from the lower surface of the connector grouper frame and linear groupers. The signal contact pins establish a connection through the coaxial connectors to the coaxial cable center signal conductors when the system is assembled. Each signal contact pin is supported in the bottom of each aperture or bore of the header chute by an upwardly protruding supporting cone of molded plastic. integral with the header chute, and extending both above the bottom surface of the chute for mating with the coaxial cable connector and below the bottom surface of the chute to mate with termination receptacles of an electrical signal transmission system, such as a printed circuit board (PCB).

Each header chute bore or aperture has a vertical slot inlet through a side wall of the bore parallel to the length of the bore. The slot houses a resilient leaf contact extending from an elongated perforated conductive ground plane affixed to the outside surface of the chute adjacent the slots in the header chute wall by fitting the perforations in the ground plane over cooperating protruding molded buttons of plastic molded into the outside surface of each header chute for that purpose. Besides furnishing a resilient contact leaf to each slot in the header chute, the ground plane includes signal contact pins on the bottom edge of the ground plane which extend below the ground plane to mate with cooperating corresponding termination receptacles on an electrical signal transmission system to ground the coaxial cables through the assembled system to the ground plane of the transmission system, such as a PCB, for example.

The header chute frame also includes means molded into its surfaces to cooperate with the header chutes bound therein to hold them together in place and also means to anchor the header chute frame to a PCB such as snap lock systems or jacking screws, bolts, pins, and the like.

Alignment pins are attached to the grouper frame to provide guidance during mating and unmating of the connector system. The header frame has alignment holes to accept the pins mounted in the grouper frame.

A series of holes is placed in the header frame and corresponding holes in the header chutes and linear grouper. Guide pins positioned in the linear groupers align each linear grouper with the header frame and its corresponding header chute. This may not be necessary in small arrays where propagation of tolerances may not create stacking error. In this case, an alternate solution for alignment of header frames and grouper frames is to extend the walls of the grouper frame such that they provide a shroud around the array of ground shells. These extended walls provide lead-in and alignment of the grouper frame surrounding the header frame during mating.

The interconnect system is assembled by terminating a coaxial electrical cable into a coaxial connector. A requisite number of coaxial connectors are inserted in the bores or apertures of a linear grouper to hold the connectors in place, the ends of the coaxial connectors extending outwardly from the bottom of the linear grouper a specified distance in order to mate with the signal pins and resilient leaves of the ground plane of a header chute. A specified number of linear groupers are inserted into and held in parallel array by the grouper frame.

Header chutes of a size and in a number to match the number of linear groupers and coaxial connectors are placed in a header frame which holds the headers in parallel array within it. The assembled header frame is mated to a PCB by insertion of the signal contact pins and ground plane contact pins into the termination receptacles of the PCB. The grouper frame is urged toward the header frame to insert the mating ends of the array of coaxial connectors into the bores or apertures of the header chutes to terminate the coaxial signal contacts onto the signal pins of the header chutes and to effect ground contact of the ground shells of the coaxial connectors with the resilient leaves of the header chute ground plane, which protrude into the slots in the sides of the bores or apertures in the header chutes.

The assembled header and grouper frames of the interconnect system may be held in contact with the PCB by appropriate hold-down frames, Jacking screws, bolts, or other such mounting hardware known in the art to be useful for that purpose. The header frames and the grouper frame may be of metal or plastic, the header chutes and linear groupers of plastic.

Individual connector groupers are removable from the system mated with a PCB and the coaxial connectors held therein individually removable, such as for replacing a defective cable or for rearranging a circuit.

DETAILED DESCRIPTION OF THE INVENTION

The high-density coaxial interconnect system of the invention is now described in terms of the drawings to more clearly describe the various component parts of the invention, the procedures for assembling the components into a complete system, and mating the system with a PCB or other electrical signal transmission system, including the features, functions of the features and components, and advantages to be gleaned thereby.

Figure 1:
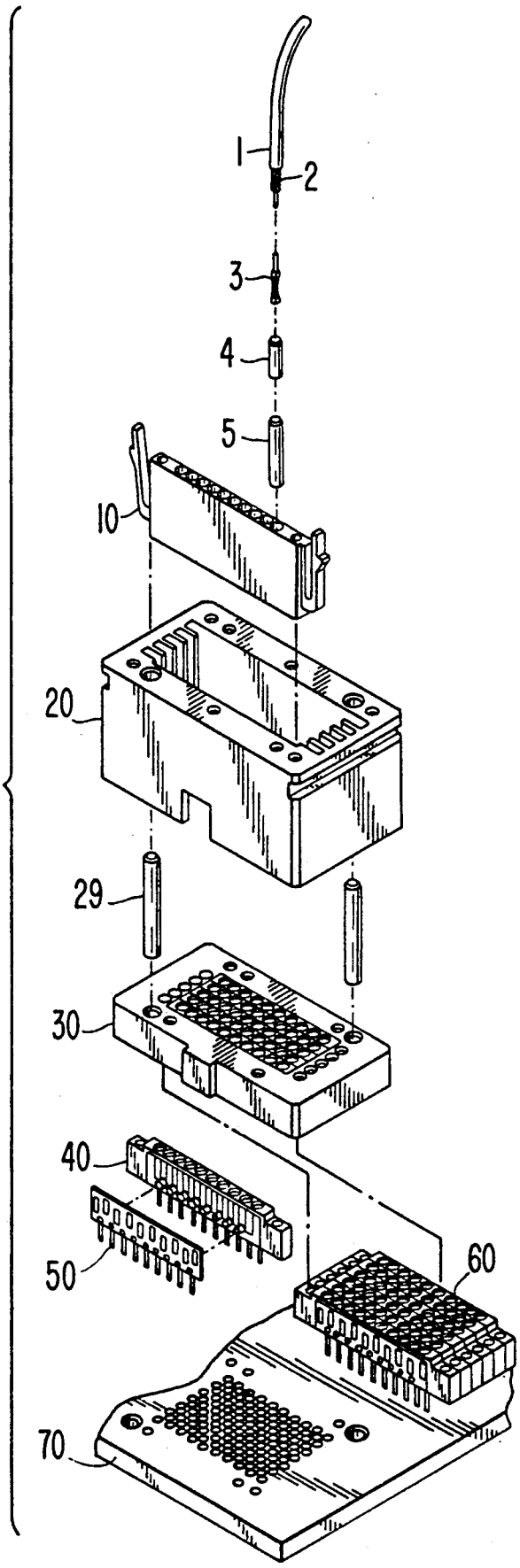
FIG. 1 is an exploded perspective view of the component parts of a coaxial interconnect system.

FIG. 1 describes in a vertically exploded perspective view the complete interconnect system of the invention beginning at the top with the components of a coaxial cable 1, which is terminated to a signal contact 3 which is surrounded by an insulator 4, which in turn is surrounded by a conductive metal ground shell 5.

A requisite number of coaxial connectors are placed in the bores or apertures of a linear grouper 10. Linear groupers 10 to fill a grouper frame 20 are inserted into grouper frame 20, where the ground shells 5 of the coaxial connectors extend below the grouper frame 20 so they may be mated in equivalent bores on signal and ground contact pins of a header chute 40. Header chutes 40 provide in the center of the bores signal contact pins and along their outside walls a ground plane 50, which contacts the ground shells 5 of the coaxial connectors with resilient leaf springs which impinge through a wall slot against the ground shells 5 within the header chutes 40 when they are fully seated in the bores. The signal contact pins and the ground contact pins of each header chute and its affixed ground plane extend downwardly to be mated with equivalent signal and ground termination receptacles or apertures in a printed circuit board (PCB) 70. The header chutes are held in parallel array 60 within a header frame 30 in a similar manner as the grouper frame 20 holds a parallel array 11 of linear groupers.

A signal is then carried from the signal conductor of cable 1 directly through the coaxial connector to the pins of header chute 40, which fit into mating signal receptacles of PCB 70. The ground shield of the cable continues complete shielding of the signal line through the ground shell 5 to the ground pins of the ground plane 50 which fit into mating ground receptacles of PCB 70. This feature greatly facilitates the increase of signal attenuation and decrease in signal loss and the reduction of crosstalk between signal conductors.

Figure 2:
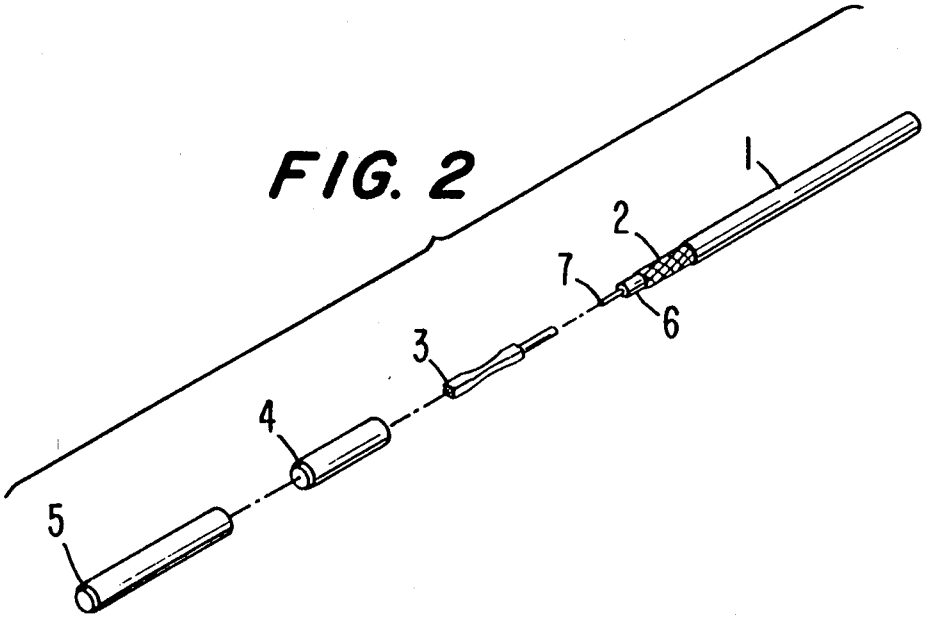
FIG. 2 is an exploded perspective view of a coaxial connector portion of the invention.

In FIG. 2, a shielded coaxial cable 1 is shown stripped for termination. The cable shield 2 is exposed for ground termination to ground shell 5. The signal-carrying center conductor 7 is terminated by one of several methods used in the art, such as crimping, soldering, or reflow soldering, brazing, or the like, for example, to a three or four beam electrical connector 3. A short band of exposed cable primary insulation 6 also separates shielding 2, center conductor 7, and connector 3. After termination of conductor 7 on connector 3, connector 3 is inserted into insulator 4 which separates connector 3 electrically from ground shell 5. Shielding 2 may be any conductive metal useful for ground circuits in the cable art, such as copper, copper alloy, aluminum, or other conductive metal in the form of served wire, braided wire or tape, or conductive metal-coated plastic film, for example. The shielding 2 may be and is usually covered by a wrapped or extruded protective polymer jacket, which may have water-excluding, oil-excluding, or abrasion resistant properties as needed for a specific application of a cable. Insulation 6 may be any electrical insulator, but is preferably a porous insulator, most preferably a porous expanded polytetrafluoroethylene material, such as those disclosed in U.S. Pat. Nos. 3,953,566, 3,962,153, 4,096,227, 4,187,390, and 4,902,423. Other low dielectric constant porous or solid insulators may be used. Insulator 4, containing connector 3 terminated to conductor 7 is then inserted into ground shell 5 which is terminated by similar methods to the above to the ground shielding 2 of cable 1 to form the coaxial connector.

Figure 3:
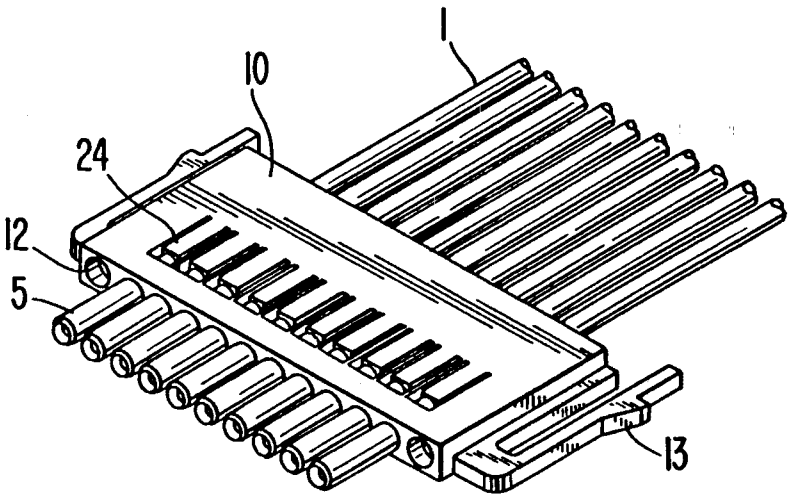
FIG. 3 is a perspective view of coaxial connectors fitted into a linear grouper.

FIG. 3 describes a linear grouper 10 which houses in apertures or bores 14 a parallel row or linear array of coaxial connectors. Cables 1 are shown entering the back face of linear grouper 10, while the ends of the ground shells 5 protrude from the front face of the linear grouper. Alignment apertures 12 parallel the bores 14 for the housing of alignment pins. A resilient arm 13 of a locking mechanism is shown cast as a part of linear grouper 10. Also provided in the side of linear grouper 10 are resilient locking arms 24 molded into slots in the wall of the linear grouper, which bear on the inside surface facing the coaxial connectors in bore 14, a latching bead 17, which fits into a crimp 9 or window formed in the ground shell 5 to hold the coaxial connector in place in linear grouper 10.

Figure 4:
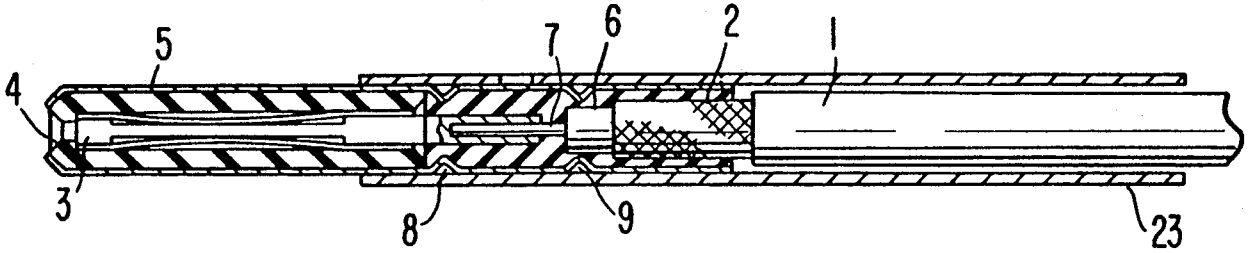
FIG. 4 is a cross-sectional view of a coaxial connector fitted into a bore or aperture in a linear grouper.

Details of the coaxial connector are depicted in FIG. 4, where the terminated cable is shown in cross-section. Coaxial connector ground shell 5 surrounds insulator 4, which in turn separates shell 5 from connector 3, which is terminated to center conductor 7. Cable primary insulation 6 extends outwardly from under cable shielding 2. A crimp 8 aids in retention of insulator 4 in the terminated coaxial connector.

Figure 5:
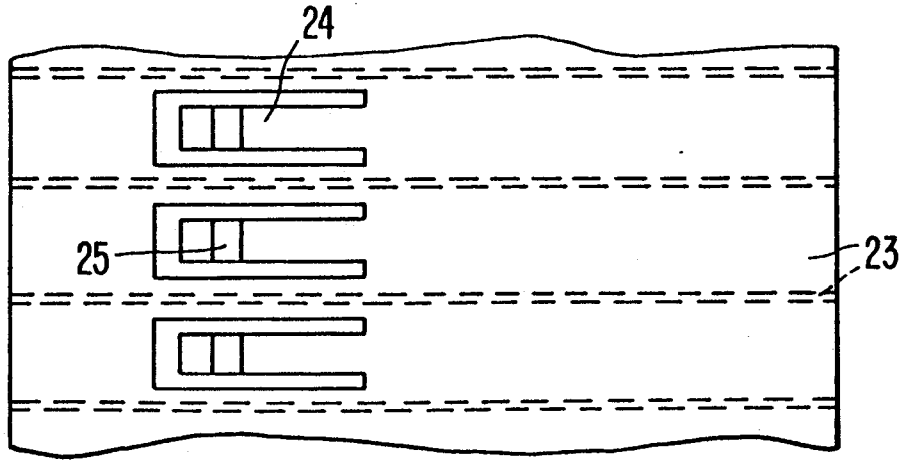
FIG. 5 is a portion of a lengthwise cross-section of a linear grouper to show the positioning of a locking arm and locking arm bead in an outer wall of the linear grouper.
Figure 6:
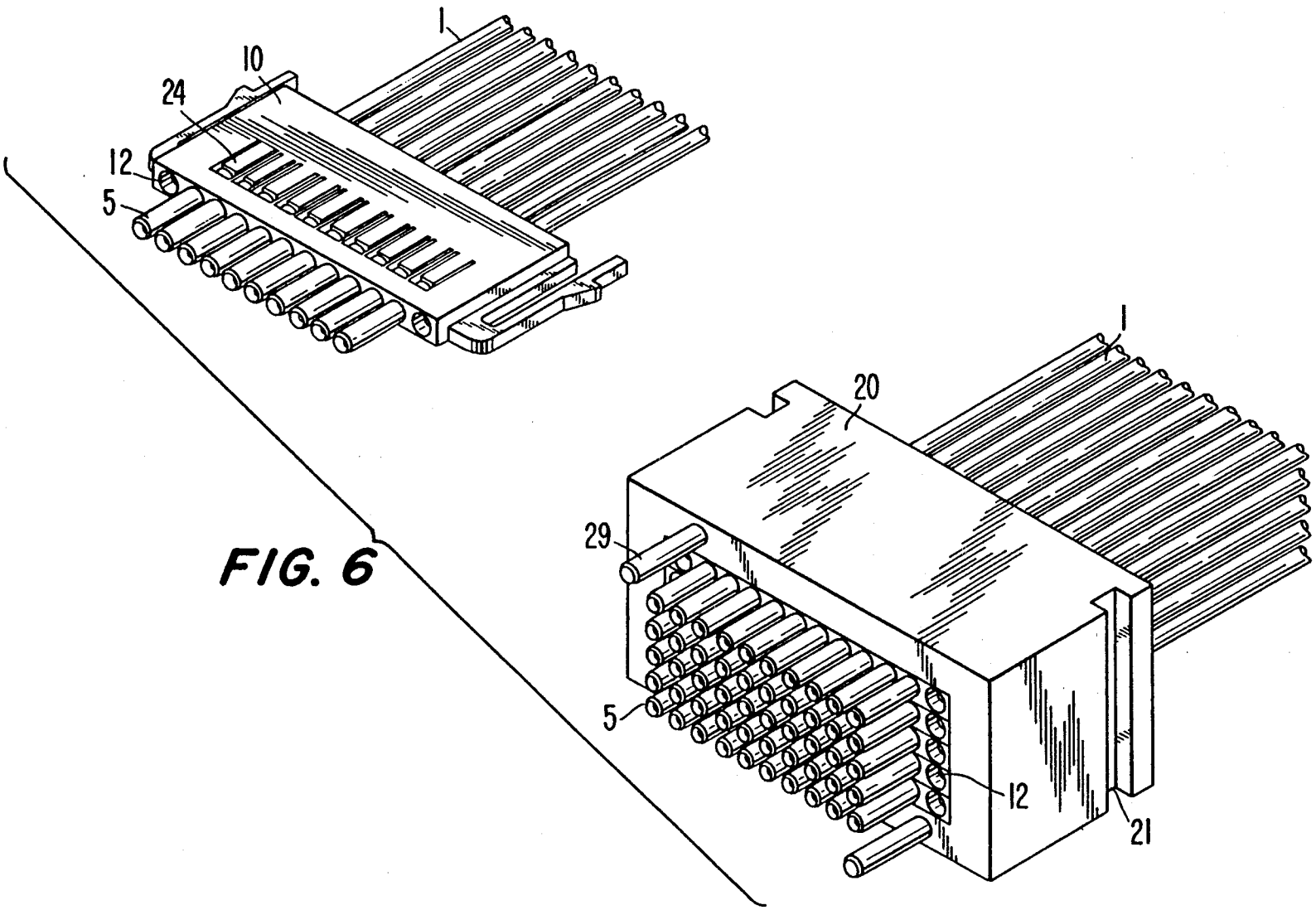
FIG. 6 is a perspective view of coaxial connectors fitted into a linear grouper and several linear groupers placed parallel to each other to fill a grouper frame.

FIG. 5 shows a cross-section of a linear grouper 10 along its length, such that the locking arm 24 which is molded into each slot of linear grouper 10 can be seen clearly. A locking arm bead 25 is molded onto each locking arm 24 to fit into crimp 9 on the coaxial connector above to hold it in place in linear grouper 10. Locking arm 24 bends outwardly from linear grouper 10 when a coaxial connector is pushed into it and returns to parallel wall 23 when bead 25 fits into crimp 9 of the coaxial connector. Arm 24 is thus out of the way in the plane of the linear grouper surface when a linear grouper is placed next to other linear groupers 10 parallel to each other in a grouper frame 20, as described in FIG. 6. Grouper frame 20 holds in place or encloses several linear groupers 10 which are latched into frame 20 by the resilient arms 13 of the locking mechanism of the linear groupers which mate with notches formed into the interior surfaces of frame 20 to accommodate them. Alignment pins 29 fit into alignment pin apertures 12 (pins not shown) of both linear groupers 10 and the grouper frame 20. The ground shells 5 of the coaxial connectors protrude from the lower face of the linear groupers in the grouper frame. One or more notches 21 may be present in the outer surfaces of grouper frame 20 to form a part of a hold-down latching mechanism to hold the system to a PCB 70.

Figure 7:
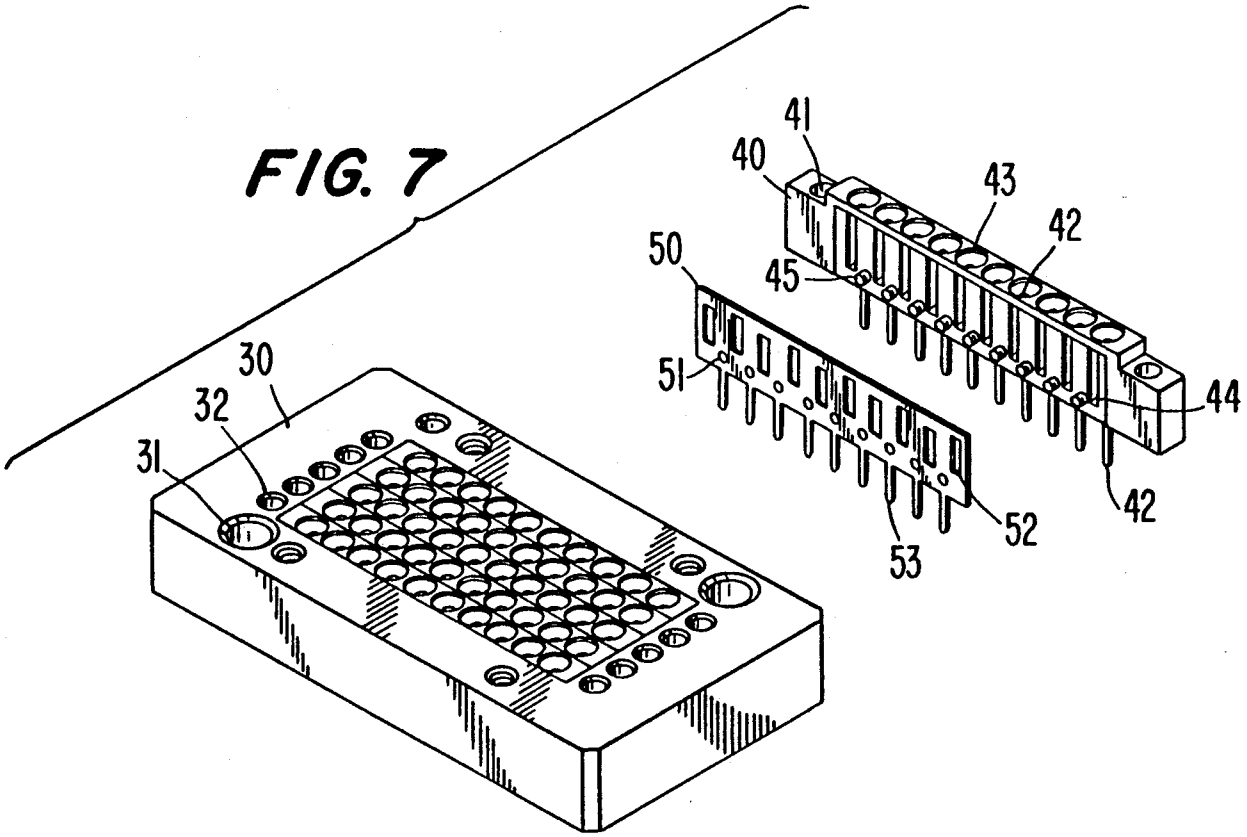
FIG. 7 is an exploded perspective view of a header chute, a conductive ground plane which fits in a slot on the side of the header chute, and a header frame into which fits a parallel array of header chutes.

FIG. 7 describes a header chute 40, formed from an elongated plastic block which has slotted bores 43 molded into it in parallel linear array to hold the ends of the coaxial connectors, the ground shells 5 of which, when inserted into bores 43, connect with signal contact pins 42 set in the bores. Each header chute has alignment apertures 41 molded into each end. Signal contact pins 42 are set into the bottom face of each bore 43 and extend into the bore for termination of the signal contacts 3 and extend below the bottom of the header chutes to make contact with connector receptacles of a PCB 70. Between each bore 43, on an outside edge near the bottom of the header chute, is molded a bead 45 which protrudes from the planar surface. Each bead 45 fits into a ground plane alignment aperture 51 to hold ground plane 50 tightly to the slotted face of header chute 40. Along the length of header chute 40 are resilient leaves 52, slit from ground plane 50 which, when ground plane 50 is held in place on the side of header chute 40, protrude into header chute bore slots 44 to contact ground shells 5 of the coaxial connectors when they are inserted into bores 43. Ground contact pins 53 are formed on the lower edge of ground plane 50. A number of header chutes are fitted together in parallel array inside header frame 30. Alignment pin apertures are molded into header frame 30 to hold alignment pins 29 which also fit into apertures 12 of the grouper frame 20. Alignment pin apertures 32 are molded into header frame 30 to align with apertures 12 in the grouper 10. Ground plane 50 is formed from a sheet of conductive metal, with resilient metals, such as beryllium-copper alloys, being preferred.

Figure 8:
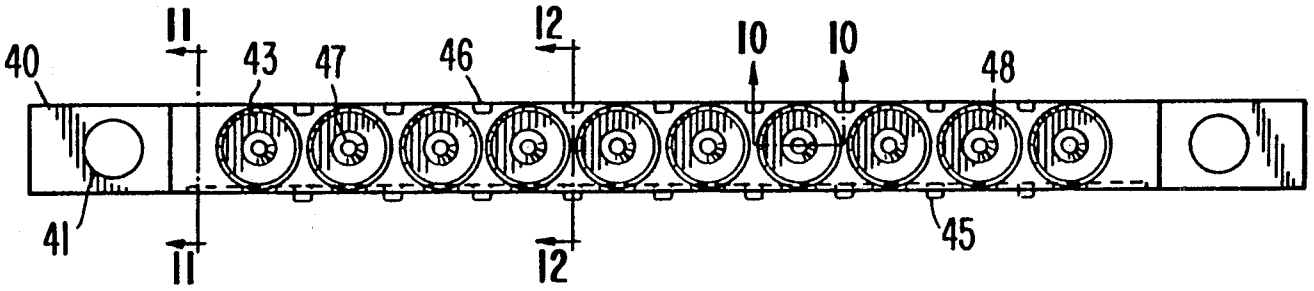
FIG. 8 is a horizontal cross-sectional view of a header chute.

FIGS. 8–13 describe various cross-sections of header chute 40 to more clearly delineate the structure of header chute 40. FIG. 8 is a cross-section taken across the bores 43 of header chute 40. Alignment bores 41 and header chute bores 43 parallel each other. Apertures 47 house signal contact pins 42. Indentations 46 to house molded beads 45 of adjacent header chutes 40 are inlet into the walls of chute 40 on the opposite side from beads 45. In the bottom of each header chute bore is molded a contact pin support cone 48 to aid in holding and firmly supporting in place parallel to the bore a signal contact pin 42. The contact pin support cone will insert into the lead-in area of the insulator surrounding the signal contact of the coaxial cable.

Figure 9:
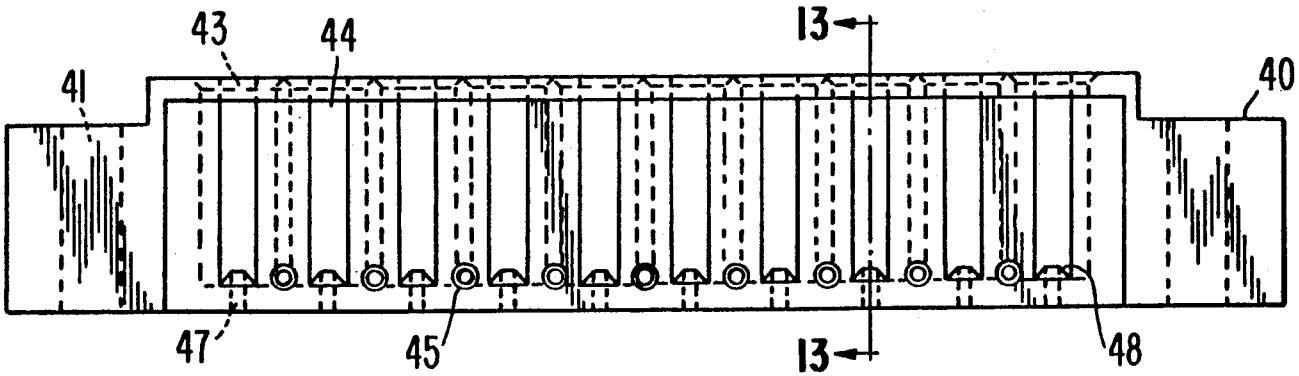
FIG. 9 is a vertical cross-sectional view of a header chute.

FIG. 9 is a cross-section taken across the length of header chute 40 parallel to the length of header chute bores 43. A slot 44 is molded into the side of each bore 43 parallel to its length. The apertures 47 for the signal contact pins 42, alignment bores 41, and contact pin support cones 48 are also shown.

Figure 10:
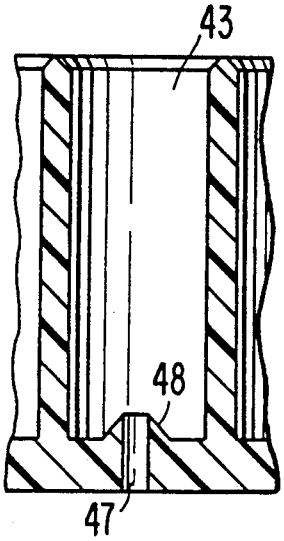
FIGS. 10, 11, 12 and 13 are cross-sectional views through four different sections of a header chute.

FIG. 10 is cross-section A—A of FIG. 8, showing header chute bore 43, contact pin support cone 48, and contact pin aperture 47.

Figure 11:
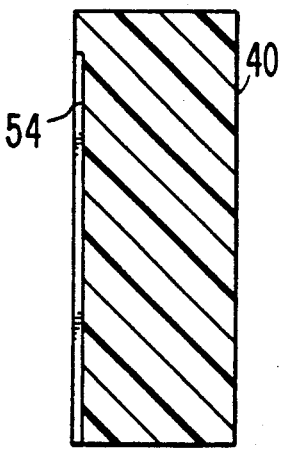

FIG. 11 is cross-section B—B of FIG. 8, which shows ground plane housing slot 54 in the side of header chute 40 which also bears the header chute bore slots 44.

Figure 12:
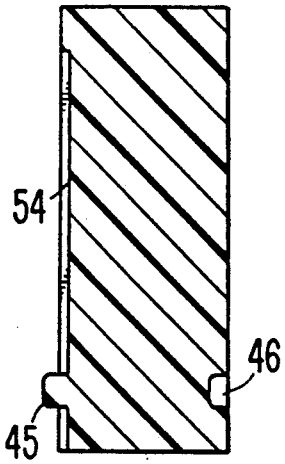

FIG. 12 shows cross-section C—C through FIG. 8 in which ground plane housing slot 54, molded head 45, and indentation 46 to house bead 45 of an adjacent header chute are shown.

Figure 13:
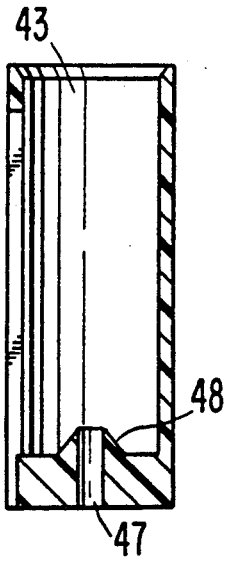

FIG. 13 is cross-section D—D of FIG. 9, including bore 43, contact pin support cone 49, and contact pin aperture 47.

Figure 14:
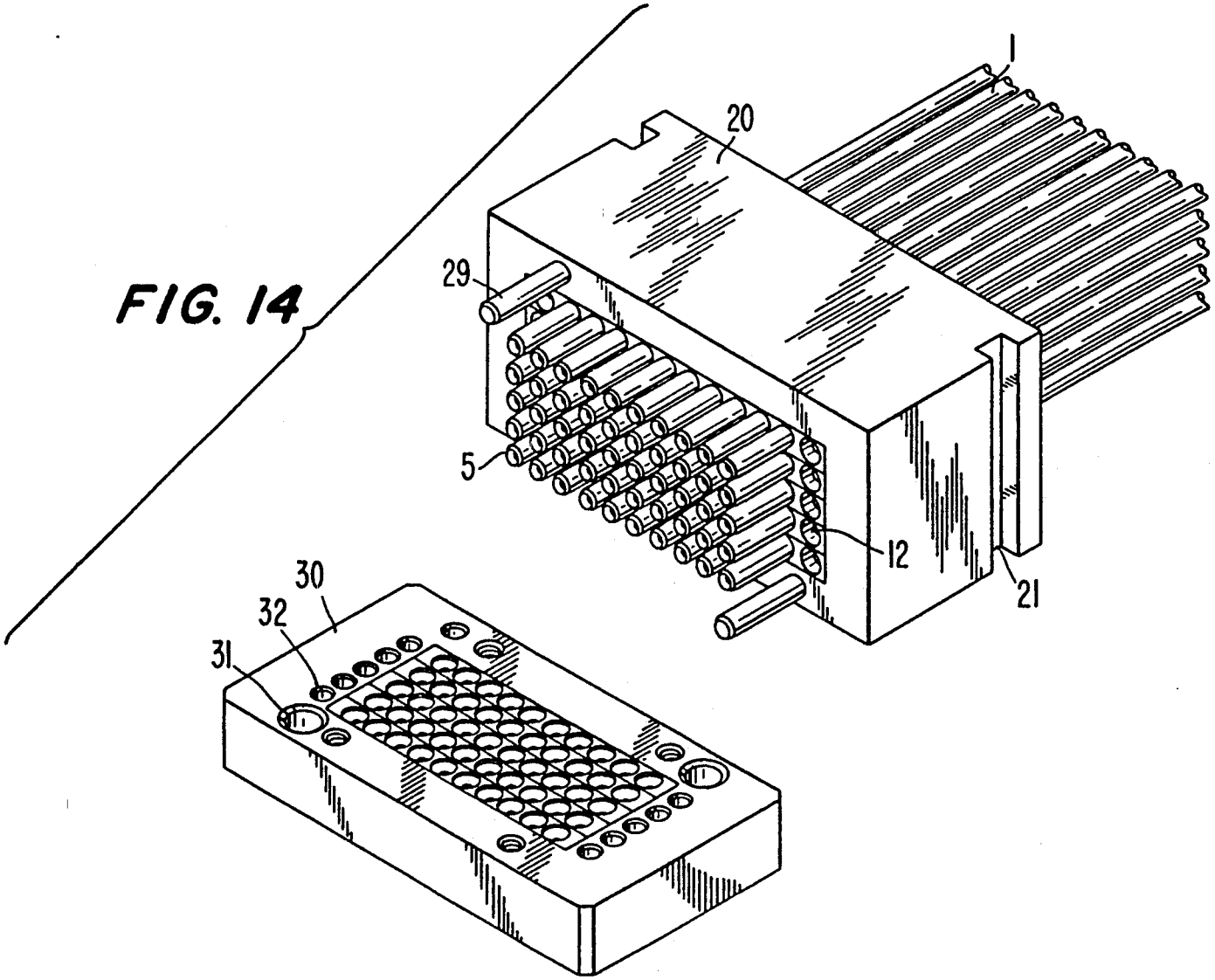
FIG. 14 is a perspective view of a grouper frame completely filled with linear groupers, which in turn are filled with coaxial connectors terminated to coaxial signal cables. The grouper frame lower surface, with protruding ends of coaxial connectors and alignment pins, is in position to be rotated onto and terminate to a header frame filled with an equivalent number of header chutes to the number of coaxial connectors.

FIG. 14 displays a grouper frame 20 filled with groupers which contain coaxial connectors. Apertures 12 will line up with apertures 32 to hold alignment pins. Alignment pins 29 will fit into pin apertures 31 to hold frame 20 in place on frame 30.

Figure 15:
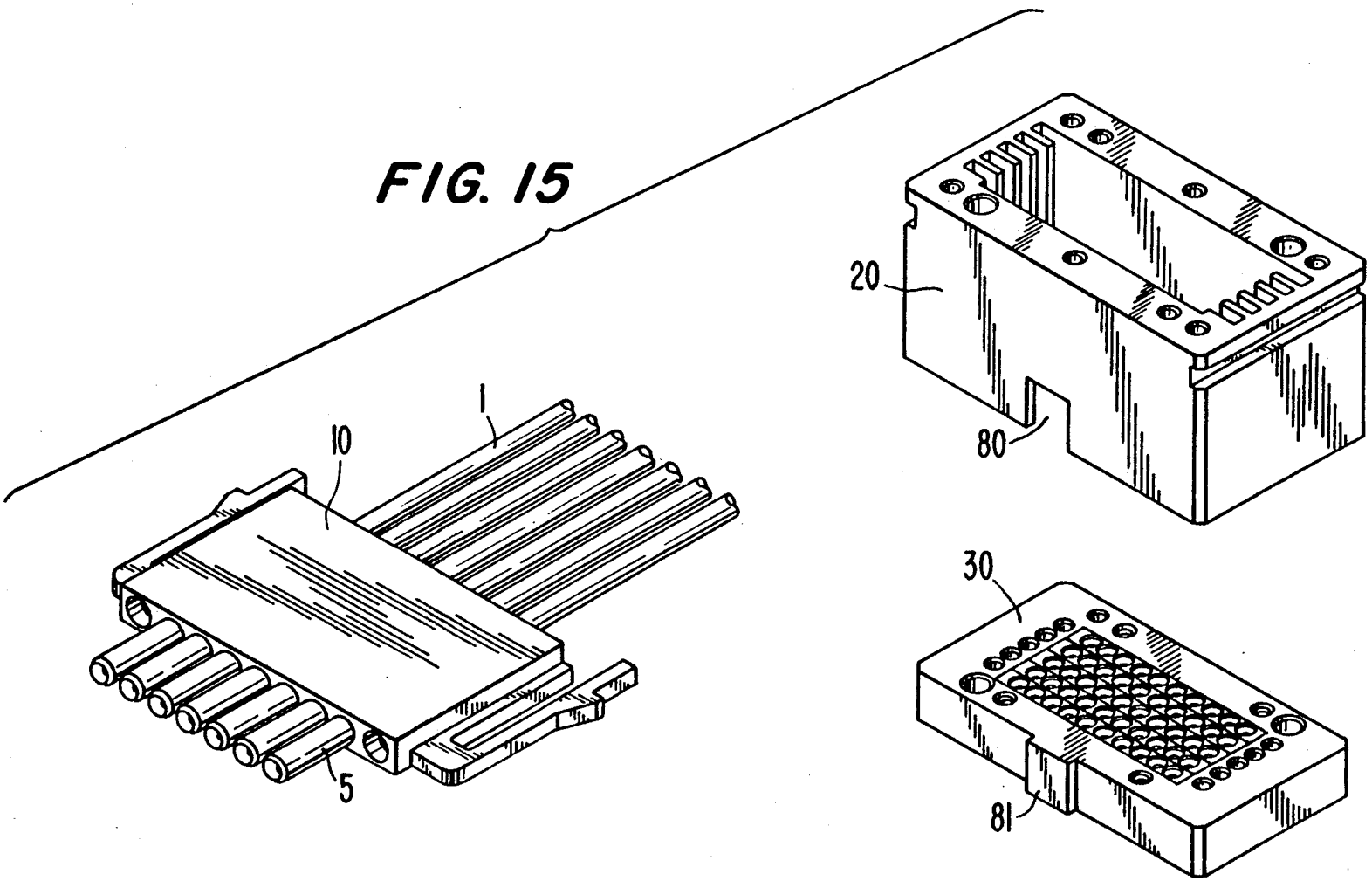
FIG. 15 is a perspective view of alternative embodiments of a grouper frame, header frame, and linear grouper.

FIG. 15 shows perspective views of a linear grouper 10 in which coaxial cables are held in place by an adhesive instead of a retention or locking mechanism molded into it and the cable, a grouper frame 20 having a slot 80 molded into its extended wall for fitting onto a polarization key 81 molded into the outer wall of header frame 30 when the two frames are assembled.

Figure 16:
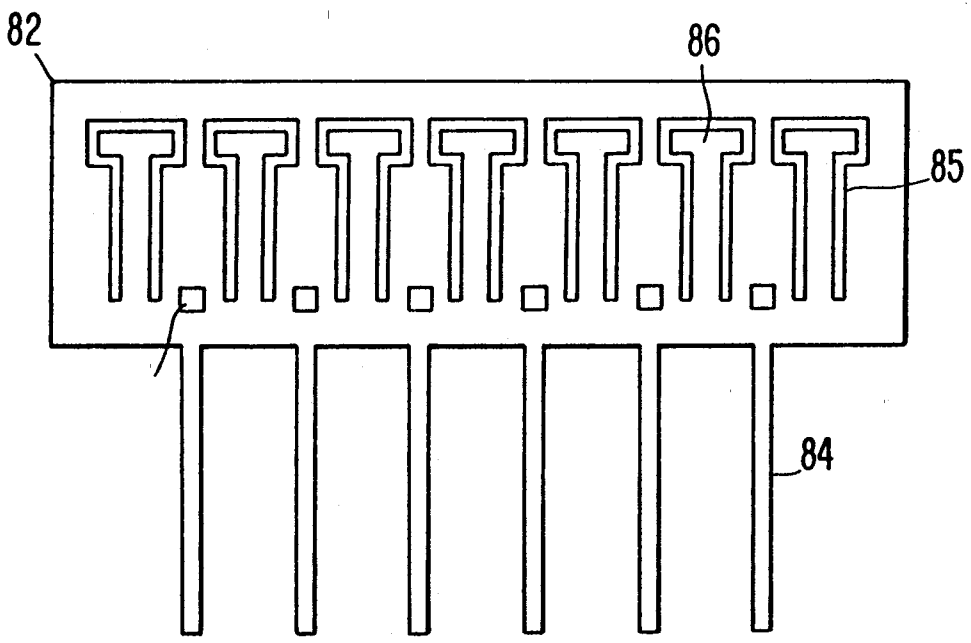
FIG. 16 is a planar view of a conductive ground plane having flexible "T" shaped leaves.

FIG. 16 is a flat planar view of an alternate form of ground plane 82 which can be substituted for ground plane 50. Slots 85 cut into ground plane 82 are "T" shaped to house "T" shaped contact leaves 86. The "T" head of the contact leaf in practice prevents the tip of the contact leaf from going inside the corresponding slot 44 in the wall of header chute 40 and stubbing a connector which is being inserted in aperture 43 in which slot 44 is inlet. This form of ground plane 82 provides improved performance for the connector assembly in that cross-talk between circuits is reduced nearly 50% as compared to a ground plane with leaf springs attached at the top and free at the bottom as in ground plane 50.

A number of advantages over prior methods, structures, and materials accrue to the inentions, including replacing metal frames with molded plastic frames to achieve lighter weight, lower manufacturing cost, and fewer problems of electrical continuity or isolation. The system of the invention achieves a smaller package by use of fewer redundant alignment pins and reduction of grouper frame and header chute wall thicknesses. A polarization key (as shown in FIG. 15) can be provided concurrently with alignment pins in the frames. A bottomless header frame improves electrical performance by allowing the signal and ground pins to be directly installed into an electrical signal transmission system, such as a PCB. The grouper frame and linear groupers provide strain relief to the coaxial connectors and cables and a means of grasping a bundle for unmating. An ejection system can be used with the backshell (the grouper frame and groupers), utilizing jack screws or a lever design. The linear groupers can be pulled from the grouper frame and replaced one at a time, and each single coaxial connector removed separately from and replaced in each linear grouper. The stacking of arrays parallel to each other with brickwalling within the frames, provide an ease and simplicity to manufacture and assembly of the various units into the ultra high-density system of the invention. The latching mechanism presently disclosed provides brickwalling of the grouper units within the grouper frame. By brickwalling is meant the close fitting together of components such that they are held in place as a unit without significant movement among them. A different method and mechanism of latching may provide, however, a means for allowing removal of individual coaxial connectors from the assembled system if complete brickwalling is not desired.

We claim:

1. An high-density coaxial interconnect system comprising the integral components:

(a) a grouper frame configured to hold at least one linear grouper;

(b) at least one linear grouper positioned in said grouper frame, said linear grouper configured with means on its inner surface to matingly engage and hold in place an array of coaxial connectors in said linear grouper;

(c) an array of coaxial connectors contained in the linear groupers comprising a coaxial signal cable terminated to a signal contact, an insulator surrounding the terminated cable and contact, and a conductive ground shell surrounding said insulator and contact., (d) said grouper frame attached to a header frame configured to house an array of juxtaposed header chutes and means to attach said header frame to header chutes housed therein., (e) header chutes comprising elongated molded plastic components, including cylindrical parallel bores configured to receive the protruding ends of the conductive ground shells of the coaxial connectors housed within said linear groupers; said header chutes having signal contact pins affixed in the bottom surfaces of each cylindrical bore therein, which houses each said conductive ground shell in alignment to form a terminating electrical contact with each said signal contact of each said coaxial signal cable when said system is assembled, each said signal contact pin being supported in said cylindrical aperture of said header chute by a protruding cone of molded plastic integral with the bottom surface of each header chute and extending both above and below the bottom surface of each said cylindrical bore of said header chute, each cylindrical bore of each header chute including a vertical slot in an outer wall parallel to the length of said bore which houses a resilient leaf contact extending from an elongated perforated conductive ground plane affixed juxtaposed to the outside surface adjacent the slots in said header chute wall by fitting the perforations therethrough over cooperating protruding bottoms of plastic molded therefor into the wall of said header chute, said ground plane also including signal contact pins integrally formed thereon extending below said ground plane, and means to attach said header chutes to said header frame;

(f) said pins of said ground plane and said signal pins housed within said cylindrical bores of said header chute being aligned for termination in the signal and ground contact receptacles of an electrical signal transmission system;

(g) said grouper frame and said header frame having an array of commonly aligned bores passing through the top and bottom surfaces thereof; and (h) a multiplicity of alignment pins housed in, passing through, and joining said frames in juxtaposition for completion of the assembly of said frames into said system and termination of said system in signal and ground receptacles of an electrical signal transmission system.

2. A system of claim 1 wherein each said linear grouper, grouper frame, header frame, and header chute is molded from plastic.

3. A system of claim 1, wherein the resilient leaf contact within said system comprises a "T"-shaped contact leaf.

4. A system of claim 1 wherein each said linear grouper is separately removable from and replaceable in said grouper frame.

5. A system of claim 4 wherein each said coaxial connector is separately removable from and replaceable in said linear grouper.

6. A high-density coaxial interconnect system comprising the integral components:

(a) a grouper frame configured to hold at least one linear grouper, said grouper frame comprising a rectangular open frame, including;
  (1) vertical slots inlet into inner surfaces to house in parallel juxtaposed array a multiplicity of linear groupers;
  (2) means formed into the interior walls of said grouper frame and said slots to matingly engage means formed into the exterior surfaces of said linear groupers to hold said linear groupers into said grouper frame; and
  (3) apertures formed into said grouper frame and passing through said grouper frame top to bottom to house alignment pins for connecting said grouper frame to other parts of an interconnect system;

(b) at least one linear grouper positioned in said grouper frame, said linear grouper configured with means on its inner surface to matingly engage and hold in place an array of coaxial connectors in said linear grouper, said linear grouper comprising:
  (1) in fixed linear juxtaposed array an array of commonly aligned parallel bores passing through the top and bottom thereof;
  (2) means formed into an outside surface of said linear grouper to matingly engage corresponding cooperating means to hold said linear grouper in place in a coaxial interconnect system;
  (3) said coaxial connectors comprising a terminated coaxial signal cable having a center conductor terminated to a signal contact, an insulator surrounding said cable terminated to said contact, and a conductive ground shell surrounding said insulator and contact;
  (4) said coaxial connectors protruding from the bottom surface of said linear grouper a required distance to be terminatable both as to ground and signal contacts of an electrical signal transmission system;

(c) said grouper frame attached to a header frame configured to house an array of juxtaposed header chutes and means to attach said header frame to header chutes housed therein;

(d) said header chute comprising:
  (1) an elongated molded plastic block having an array of parallel cylindrical bores traversing said block from top to bottom and configured to receive and terminate signal pins and ground shells of a multiplicity of coaxial connectors;
  (2) said block having signal contact pins affixed in the bottom of each cylindrical bore supported by a protruding cone of material integral with the bottom surface of each said bore, said pins extending both above and below the bottom of each said block to be matable with the signal contacts of coaxial connectors in the bores and matable with termination receptacles of an electrical signal transmission system in position below said block;
  (3) said block including a vertical slot formed in a side of each said bore parallel to the length of said bore; said block including buttons formed on the side of said block located between said slots in said bores and apertures formed in the opposite side of said block from said buttons and configured to be able to house the ends of buttons formed into an adjacent block juxtaposed to said block; and
  (4) a perforated conductive ground plane affixed on said buttons adjacent said slots in said block and including perforations to house said buttons and hold said ground plane to said block, elongated resilient "T"-shaped leaf contacts formed from the material of said ground plane and extending partially into said slots of said block, contact pins internally formed into the lower edge of said ground plane and extending below said ground plane and said block in an even alignment to be matable with ground termination receptacles of an electrical transmission system;

(e) said pins of said ground plane and said signal pins housed within said cylindrical bores of said header chute being aligned for termination in the signal and ground contact receptacles of an electrical signal transmission system;

(f) said grouper frame and said header frame having an array of commonly aligned bores passing through the top and bottom surfaces thereof; and (g) a multiplicity of alignment pins housed in, passing through, and joining said frames in juxtaposition for completion of the assembly of said frames into said system and termination of said system in signal and ground receptacles of an electrical signal transmission system.

7. The coaxial interconnect system of claim 6 wherein said ground plane comprises an electrically conductive metal.

8. The coaxial interconnect system of claim 6 wherein the header frame includes slots or protuberances molded into said frame for cooperating with hold-down apparatus.

9. The coaxial interconnect system of claim 6 wherein the linear grouper additionally includes extended side walls, one of which side walls contains a slot for mating with a polarization key molded into a side wall of a header frame.

10. The coaxial interconnect system of claim 6 wherein the header frame additionally includes a polarization key molded into a side wall for mating with a slot in a linear grouper.

11. The coaxial interconnect system of claim 6 in which the means to engage and hold in place a coaxial connector comprises an adhesive.

* * * * *